US008653749B2

(12) United States Patent
Hwang et al.

(10) Patent No.: US 8,653,749 B2
(45) Date of Patent: Feb. 18, 2014

(54) LED DRIVING DEVICE

(75) Inventors: Bo Hyun Hwang, Gyeonggi-do (KR); Jung Sun Kwon, Gyeonggi-do (KR); Seung Kon Kong, Gyeonggi-do (KR); Jung Hyun Kim, Gyeonggi-do (KR); Jae Shin Lee, Gyeonggi-do (KR); Joon Youp Sung, Gyeonggi-do (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 278 days.

(21) Appl. No.: 13/108,535

(22) Filed: May 16, 2011

(65) Prior Publication Data

US 2012/0212152 A1 Aug. 23, 2012

(30) Foreign Application Priority Data

Feb. 21, 2011 (KR) ..... 10-2011-0015107

(51) Int. Cl.
*H05B 37/02* (2006.01)

(52) U.S. Cl.
USPC ..... 315/291; 315/192

(58) Field of Classification Search
None
See application file for complete search history.

(56) References Cited

U.S. PATENT DOCUMENTS 7,733,034 B2 6/2010 Kotikalapoodi et al.
8,004,207 B2 * 8/2011 Elder ..... 315/291
8,115,414 B2 * 2/2012 Zhao et al. ..... 315/299
8,179,051 B2 * 5/2012 Zhao ..... 315/185 R
2007/0114921 A1 * 5/2007 Yamazaki et al. ..... 313/504
2007/0114951 A1 * 5/2007 Tsen et al. ..... 315/291
2009/0273288 A1 * 11/2009 Zhao et al. ..... 315/185 R
2010/0156315 A1 * 6/2010 Zhao et al. ..... 315/294
2010/0201278 A1 * 8/2010 Zhao ..... 315/185 R
2010/0201279 A1 * 8/2010 Zhao ..... 315/185 R
2011/0109243 A1 * 5/2011 Kim et al. ..... 315/294
2012/0086357 A1 * 4/2012 Tseng ..... 315/294

FOREIGN PATENT DOCUMENTS

KR 10-2005-0003971 A 1/2005

* cited by examiner

*Primary Examiner* — Crystal L Hammond
(74) *Attorney, Agent, or Firm* — McDermott Will & Emery LLP

(57) ABSTRACT

Disclosed herein is a light emitting diode (LED) driving device for driving a multi-channel LED element or an LED array for each channel, the LED driving device including: a constant current driver driving currents flowing in each channel; and a minimum voltage selector receiving voltage levels of each channel and selecting a minimum voltage level to thereby feedback the selected minimum voltage level to the constant current driver, wherein matching characteristics of currents flowing in each channel is improved and a size of an integrated circuit (IC) chip is also reduced as compared to a case according to the related art, thereby making it possible to reduce a production cost and satisfy the trend of miniaturization of the chip, while solving a performance deterioration problem due to deterioration of the matching of the currents between the channels.

12 Claims, 3 Drawing Sheets

- PRIOR ART -

LED DRIVING DEVICE

CROSS REFERENCE(S) TO RELATED APPLICATIONS

This application claims the benefit under 35 U.S.C. Section 119 of Korean Patent Application Serial No. 10-2011-0015107, entitled "LED Driving Device" filed on Feb. 21, 2011, which is hereby incorporated by reference in its entirety into this application.

BACKGROUND OF THE INVENTION

1. Technical Field

The present invention relates to a light emitting diode (LED) driving device, and more particularly, to an LED driving device capable of having a compact size, while solving a problem that a degree of scattering of a current increases due to the use of a plurality of amplifiers in driving the LED in a multi-channel driving scheme.

2. Description of the Related Art

A light emitting diode (LED) has been widely used in various fields such as illumination, a backlight unit (BLU), or the like. Recently, as a market of the LED has quickly expanded, the related technology has been rapidly advanced.

Generally, an LED current is mainly set and controlled by conversion dimming signal (ADIM) and resistor (RLED) parameters.

Meanwhile, in a light emitting diode back light unit (LED BLU), a multi-channel driving scheme has been used in order to use partial dimming and scanning functions. At the same time, a linear scheme has been used in order to maintain the same brightness.

The linear scheme is advantageous in terms of a cost. However, in this scheme, in order to constantly maintain currents of LED channels, amplifiers have been respectively used for each channel. Each of the amplifiers indicates unique offset voltage characteristics, such that a degree of scattering of currents between each channel increases, thereby reducing matching characteristics between the channels.

FIG. 1 shows a linear constant current driving scheme of a general multi-channel LED according to the related art.

As shown in FIG. 1, each of the amplifiers has an offset voltage Vos.

Therefore, currents for each channel are determined as given in Equations below. It may be appreciated that all of the currents for each channel become different, such that matching characteristics of the currents for each channel are reduced.

$$I_{CH1} = \frac{ADIM - V_{OS1}}{R}$$

$$I_{CH2} = \frac{ADIM - V_{OS2}}{R}$$

$$I_{CH3} = \frac{ADIM - V_{OS3}}{R}$$

In order to improve the matching characteristics of the currents for each channel, a method of providing an additional compensation circuit or designing a multi-stage amplifier may be used. However, this method causes not only an increase in the entire chip size, but also causes an increase in a production cost of a chip.

SUMMARY OF THE INVENTION

An object of the present invention is to provide an LED driving device capable of improving matching characteristics of currents for each channel and miniaturizing an integrated circuit (IC) chip as compared to a case according to the related art.

According to an exemplary embodiment of the present invention, there is provided a light emitting diode (LED) driving device for driving a multi-channel LED element or an LED array for each channel, the LED driving device including: a constant current driver driving currents flowing in each channel; and a minimum voltage selector receiving voltage levels of each channel and selecting a minimum voltage level to thereby feedback the selected minimum voltage level to the constant current driver.

The constant current driver may include: a driving amplifier including a non-inverting terminal to which a reference voltage is applied and an inverting terminal to which a voltage fed-back by the minimum voltage selector is applied; a driving transistor including a control terminal connected to an output terminal of the driving amplifier and a first terminal connected to one end of the LED element or the LED array; and a driving resistor connected to a second terminal of the driving transistor and providing a feedback voltage level linearly corresponding to the current flowing in the LED element or the LED array.

The constant current driver may further include a buffer connected between the output terminal of the driving amplifier and the control terminal of the driving transistor, and the buffer may further have a pulse width modulation (PWM) control signal and/or an amplitude modulation (AM) control signal applied thereto.

The minimum voltage selector may include at least one selecting unit outputting one of a plurality of input voltage levels.

The minimum voltage selector may include at least one comparing unit comparing magnitudes of a plurality of input voltage levels.

The selecting unit may be implemented by a multiplexer (MUX), and the comparing unit may be implemented by an amplifier (AMP).

According to another exemplary embodiment of the present invention, there is provided a light emitting diode (LED) driving device for driving an LED device for each channel, the LED device including N LED channels each configured by connecting N LED arrays configured of at least one LED element in parallel, the LED driving device including: a driving amplifier including a non-inverting terminal having a reference voltage applied thereto; N driving transistors including a control terminal connected to an output terminal of the driving amplifier and a first terminal connected to one end of the LED array of each channel; N driving resistors connected to second terminals of each of the N driving transistors and providing feedback voltage levels linearly corresponding to the currents flowing in the LED array of each channel; and a minimum voltage selector having one end connected between the second terminal of each of the driving transistors and each of the driving resistors and the other end connected to an inverting terminal of the driving amplifier.

The LED driving device may further include N buffers connected between the output terminal of the driving amplifier and the control terminals of each of the driving transistors, and the buffer may further have a PWM control signal and/or an AM control signal applied thereto.

The minimum voltage selector may include at least one selecting unit outputting one of a plurality of input voltage levels.

The minimum voltage selector may include at least one comparing unit comparing magnitudes of a plurality of input voltage levels.

The selecting unit may be implemented by a multiplexer (MUX), and the comparing unit may be implemented by an amplifier (AMP).

DESCRIPTION OF THE PREFERRED EMBODIMENTS

Figure 1:
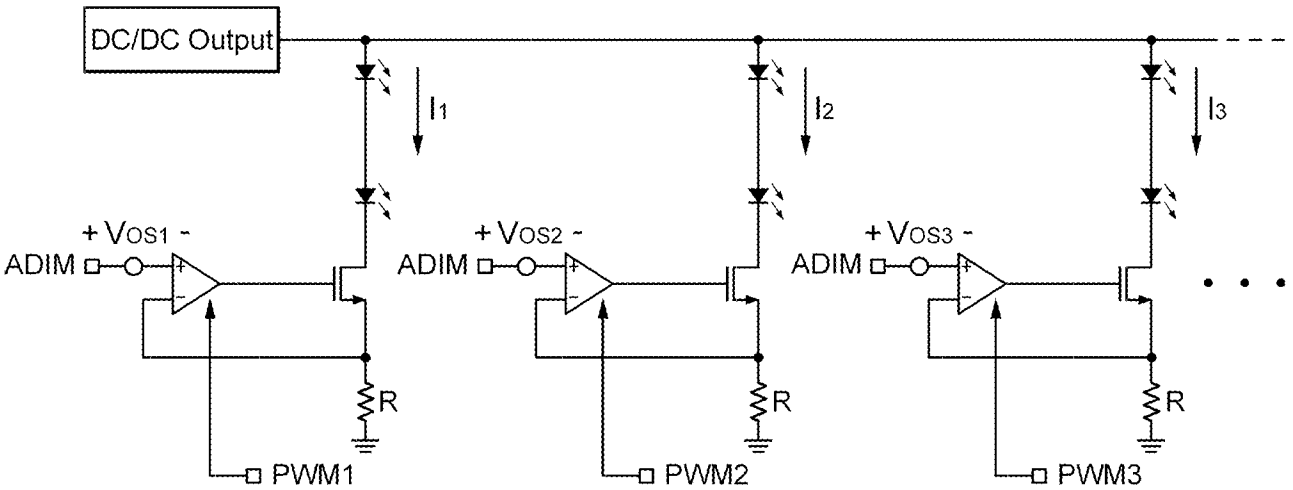
FIG. 1 is a circuit diagram showing a configuration of an LED driving device according to the related art.

Various advantages and features of the present invention and methods accomplishing thereof will become apparent from the following description of embodiments with reference to the accompanying drawings. However, the present invention may be modified in many different forms and it should not be limited to the embodiments set forth herein. These embodiments may be provided so that this disclosure will be thorough and complete, and will fully convey the scope of the invention to those skilled in the art. Like reference numerals throughout the description denote like elements.

Terms used in the present specification are for explaining the embodiments rather than limiting the present invention. Unless explicitly described to the contrary, a singular form includes a plural form in the present specification. The word "comprise" and variations such as "comprises" or "comprising," will be understood to imply the inclusion of stated constituents, steps, operations and/or elements but not the exclusion of any other constituents, steps, operations and/or elements.

Hereinafter, a configuration and operation of the present invention will be described in detail with reference to the accompanying drawings.

Figure 2:
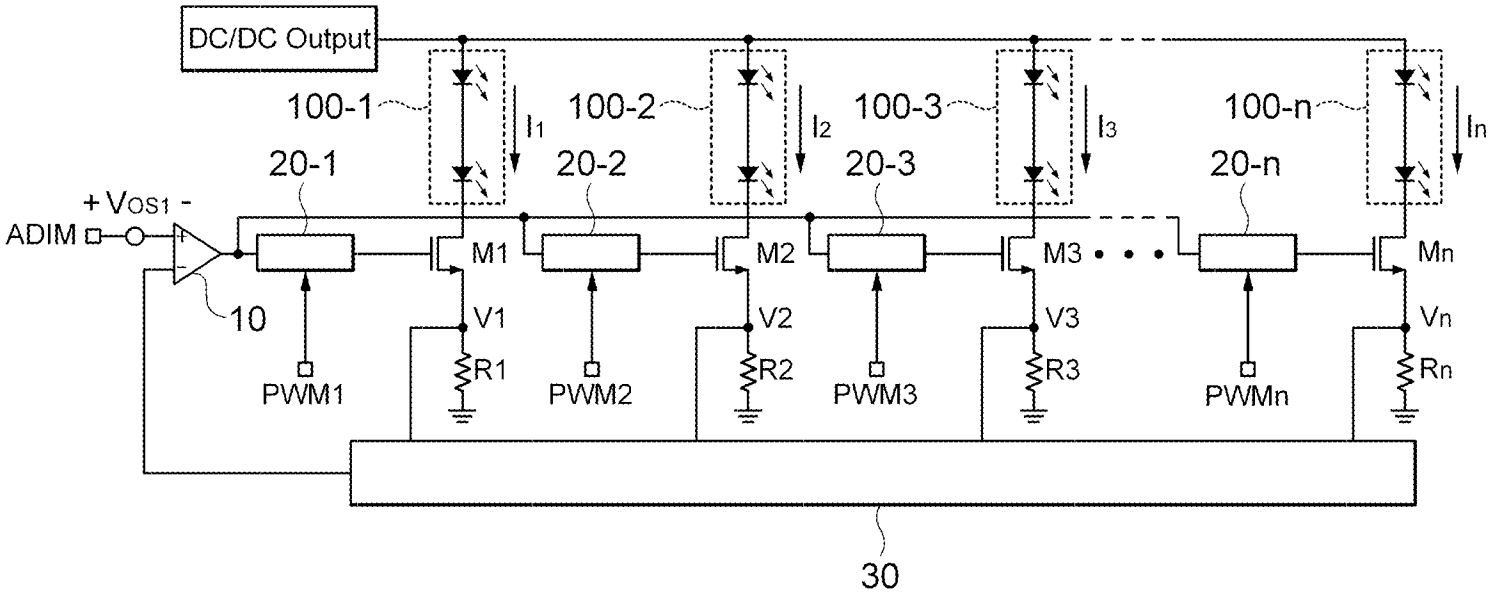
FIG. 2 is a circuit diagram showing a configuration according to an exemplary embodiment of the present invention.

FIG. 2 is a circuit diagram showing a configuration according to an exemplary embodiment of the present invention.

Referring to FIG. 2, an LED driving device according to an exemplary embodiment of the present invention may be configured to include a constant current driver and a minimum voltage selector 30.

A light emitting diode (LED) array 100 may be configured by connecting at least one LED elements in series. In addition, each of the channels may be configured by connecting a plurality of LED arrays 100 in parallel. Although not shown, the LED array 100 may also be configured of a single LED element, and a single channel may also be configured of a single LED element.

A configuration and an operating principle of the constant current driver are similar to those of the constant current driver according to the related art.

LED currents for each channel flowing in a string configuring the LED array 100 flow into a first terminal of a driving transistor, and are maintained, are amplified or flow into a second terminal of the driving transistor according to a signal applied to a control terminal of the driving transistor.

The currents flowing from the second terminal of the driving transistor form feedback voltage levels by driving resistors, wherein the feedback voltage levels are connected to a driving amplifier 10 to thereby be compared with a reference voltage.

The driving amplifier 10 compares the feedback voltage levels with an applied reference voltage and amplifies a difference therebetween by a preset voltage gain to output the amplified voltage difference in a signal form at an output terminal thereof. The output terminal of the driving amplifier 10 is connected to the control terminal of the driving transistor, thereby making it possible to maintain or increase the LED currents for each channel.

Here, the driving transistor may be implemented as a junction transistor, a MOS transistor, or the like.

In the case in which a plurality of channels are provided, according to the related art, since amplifiers should be provided as many as the number of channels, as shown in FIG. 1, the above-mentioned problems were caused. However, according to the present invention, the driving transistors and the driving resistors are provided for each channel, all of the control terminals of the driving transistors are connected to a single driving amplifier 10, and the minimum voltage selector 30 is provided so that a minimum voltage level of the feedback voltage levels of all channels may be selected and be input as feedback to an inverting terminal of the driving amplifier 10, as shown in FIG. 2, thereby making it possible to solve the matching characteristics of the currents for each channel due to the offset of the amplifier, which was the problem according to the related art, without providing an additional compensation circuit.

The LED currents of all channels may be driven at a predetermined level by the single driving amplifier 10 through the above-mentioned configuration.

Meanwhile, buffers 20 may be provided between an output terminal of the driving amplifier 10 and the control terminals of the driving transistors and be configured to apply pulse width modulation (PWM) control signals therethrough.

The PWM control signal may be used to implement dimming or scanning operations for each channel, etc. Although not shown, amplitude modulation (AM) control signals may be used, instead of the PWM control signals to thereby perform an additional control or both of the two kinds of control signals may be used.

Meanwhile, when additional control signals such as the PWM control signals, etc., are applied as described above, excessive signals are instantaneously applied, such that the LED currents for each channel are rapidly changed, thereby making it possible to cause damage of an element. Therefore, the buffer 20 capable of mitigating the excessive signal is preferably provided. Buffers 20 having various configurations that have already been widely used may be used as the buffer 20. Accordingly, a detailed description thereof will be omitted.

Figure 3:
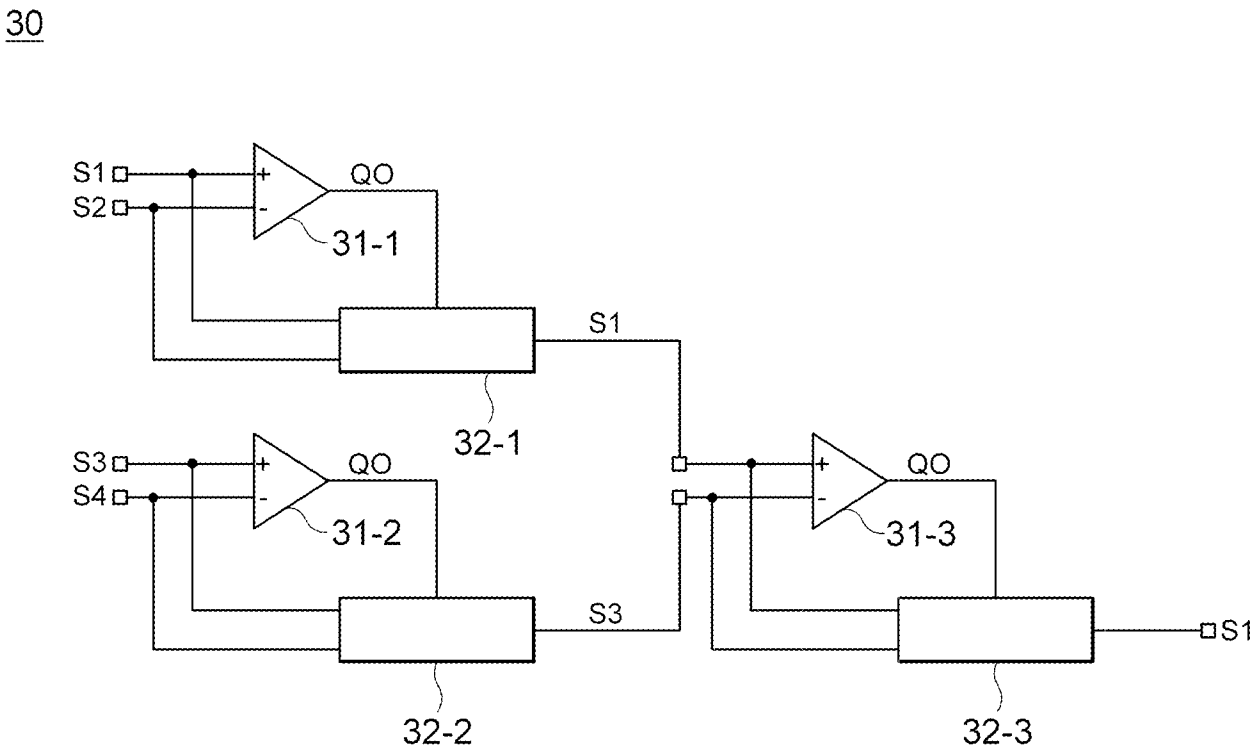
FIG. 3 is an enlarged view showing main parts according to an exemplary embodiment of the present invention.

FIG. 3 shows an example of implementing the minimum voltage selector 30 according to an exemplary embodiment of the present invention.

The minimum voltage selector 30 receives the voltage levels of all channels and outputs the minimum voltage level, thereby making it possible to allow the minimum voltage level to be applied to the amplifier of the constant current driver.

The amplifier compares the minimum voltage level of the voltage levels for each channel input from the minimum voltage selector 30 with the reference voltage and output a control signal. And the control signal is applied to the control terminals of the driving transistors of all the channels, thereby making it possible to maintain the LED currents of all channels at a predetermined level or more.

Meanwhile, the minimum voltage selector 30 preferably includes a selecting unit and/or a comparing unit in order to perform the above-mentioned operation.

The selecting unit serves to receive the voltage levels of each channel and output a single voltage level. As a typical example of a component having the above-mentioned operation characteristics, there is a multiplexer (MUX) 32.

The multiplexer 32 is a combinational circuit selecting one of several inputs and connecting the selected input to a single output. Since the multiplexer receives multi-input data and outputs single data, it is also called a data selector.

Meanwhile, although the selector unit may receive multiple inputs and perform a single output as described above, a comparing unit capable of comparing magnitudes of the input voltage levels may be required in order to output the minimum voltage level as in the present invention.

As a typical example of the above-mentioned comparing unit, there is an amplifier (AMP).

The amplifier is generally a device that increases energy of an input signal to thereby output the signal having a large energy change at an output side. Since the amplifier may determine an output value according to values input to two input terminals it may be widely used as a comparator.

FIG. 3 shows a principle of outputting a minimum value or a maximum value of four input values using the amplifier (AMP) 31 and the multiplexer (MUX) 32.

Hereinafter, a process of selecting a minimum voltage will be described with reference to FIG. 3.

When an L signal is input as a control signal, the MUX is set to output a first input value, on the assumption that S1<S2<S3<S4.

When S1 is compared with S2 in a first AMP 31-1, S1 is smaller than S2. Therefore, the first AMP 31-1 outputs the L signal at its output terminal.

When the L signal is input as a control signal to a first MUX 32-1, the first MUX outputs S1, which is a first value of S1 and S2.

S3, which is a smaller value of S3 and S4, is output by a second AMP 31-2 and a second MUX 32-2 in the same scheme.

S1 of S1 and S3 is once again selected and output by a third AMP 31-3 and a third MUX 32-3.

The minimum voltage selector 30 according to the exemplary embodiment of the present invention may be implemented using the appropriate number of amplifiers 31 and multiplexers 32 according to the number of channels based on the above-mentioned principle.

Meanwhile, in the case in which the minimum voltage selector is implemented through the above-mentioned scheme, when the number of channels is increased, the number of required amplifiers 31 and multiplexers 32 is increased, such that a production cost may be increased and a product size may be enlarged.

Therefore, there is also a need to implement the minimum voltage selector through another scheme in consideration of an allowable size of a product and the number of channels thereof.

In the case in which the minimum voltage selector is implemented by a selecting unit outputting one of a plurality of voltage levels and a microcomputer, the microcomputer may compare values input to the selector unit to thereby transmit a control command to the selecting unit, and the selecting unit may select and output the minimum voltage level.

In addition, in the case in which a comparing unit is implemented by the microcomputer as described above, an average value of each channel may be calculated.

However, in the case in which the comparing unit is implemented by the microcomputer as described above, it may take a predetermined time to process data in the microcomputer, such that delay may be generated in a feedback process.

It is preferable to adopt appropriate components according to conditions such as the number of channels, an allowable size of a product, an allowable range of feedback delay, and the like in consideration of the above-mentioned points.

With the present invention configured as described above, a plurality of channels are driven at a constant current by a single amplifier, thereby making it possible to solve the problems that a separate compensation circuit for compensating for a difference in offsets for each channel should be provided in the multi-channel LED driving device according to the related art.

In addition, the number of amplifiers for constant current driving of each channel is reduced, such that matching characteristics of currents flowing in each channel is improved, thereby making it possible to solve a performance deterioration problem due to deterioration of the matching of the currents between the channels.

Further, the number of amplifiers is reduced and the separate compensation circuit is not required, such that a size of an integrated circuit (IC) chip is also reduced as compared to a case according to the related art, thereby making it possible to satisfy the trend of miniaturization of the chip.

The present invention has been described in connection with what is presently considered to be practical exemplary embodiments. Although the exemplary embodiments of the present invention have been described, the present invention may be also used in various other combinations, modifications and environments. In other words, the present invention may be changed or modified within the range of concept of the invention disclosed in the specification, the range equivalent to the disclosure and/or the range of the technology or knowledge in the field to which the present invention pertains. The exemplary embodiments described above have been provided to explain the best state in carrying out the present invention. Therefore, they may be carried out in other states known to the field to which the present invention pertains in using other inventions such as the present invention and also be modified in various forms required in specific application fields and usages of the invention. Therefore, it is to be understood that the invention is not limited to the disclosed embodiments. It is to be understood that other embodiments are also included within the spirit and scope of the appended claims.

What is claimed is:

1. A light emitting diode (LED) driving device for driving a multi-channel LED element or an LED array for each channel, the LED driving device comprising:

a plurality of driving transistors each including a first terminal connected to each end of the LED elements or the LED array;

a plurality of driving resistors each connected to a second terminal of the driving transistors and each providing a feedback voltage level linearly corresponding to a current flowing in the LED element or the LED array:

a driving amplifier including an output terminal connected to all of control terminals of the plurality of driving transistors and a non-inverting terminal to which a reference voltage is applied; and a minimum voltage selector receiving the feedback voltage level of each channel and selecting a minimum voltage level to thereby feedback the selected minimum voltage level to an inverting terminal of the driving amplifier.

2. The LED driving device according to claim 1, further comprising:

buffers connected between the output terminal of the driving amplifier and each of the control terminals of the driving transistor, wherein a pulse width modulation (PWM) control signal and/or an amplitude modulation (AM) control signal are applied to the buffers.

3. The LED driving device according to claim 1, wherein the minimum voltage selector includes:

at least one selecting unit outputting one of a plurality of input voltage levels: and at least one comparing unit comparing magnitudes of a plurality of input voltage levels, wherein the comparing unit s an amplifier and the selecting unit is a multiplexer applied an output signal of the amplifier.

4. The LED driving device according to claim 3, wherein the selecting unit is a multiplexer (MUX).

5. The LED driving device according to claim 1, wherein the minimum voltage selector includes at least one comparing unit comparing magnitudes of a plurality of input voltage levels.

6. The LED driving device according to claim 5, wherein the comparing unit is an amplifier (AMP).

7. A light emitting diode (LED) driving device for driving an LED device for each channel, the LED device including N LED channels each configured by connecting N LED arrays configured of at least one LED element in parallel, the LED driving device comprising:

N driving transistors including a control terminal and a first terminal connected to one end of the LED array of each channel;

N driving resistors connected to second terminals of each of the N driving transistors and providing feedback voltage levels linearly corresponding to the currents flowing in the LED array of each channel;

a driving amplifier including an output terminal connected to all of control terminals of the driving transistors and a non-inverting terminal to which a reference voltage is applied; and a minimum voltage selector having one end connected between the second terminal of each of the driving transistors and each of the driving resistors and the other end connected to an inverting terminal of the driving amplifier.

8. The LED driving device according to claim 7, further comprising:

N buffers connected between the output terminal of the driving amplifier and the control terminals of each of the driving transistors, wherein a PWM control signal and/or an AM control signal are applied to the buffers.

9. The LED driving device according to claim 7, wherein the minimum voltage selector includes:

at least one selecting unit outputting one of a plurality of input voltage levels: and at least one comparing unit comparing magnitudes of a plurality of input voltage levels, wherein the comparing unit is an amplifier and the selecting unit is a multiplexer applied an output signal of the amplifier.

10. The LED driving device according to claim 9, wherein the selecting unit is a multiplexer (MUX).

11. The LED driving device according to claim 7, wherein the minimum voltage selector includes at least one comparing unit comparing magnitudes of a plurality of input voltage levels.

12. The LED driving device according to claim 11, wherein the comparing unit is an amplifier (AMP).

* * * * *